US009894733B1

(12) United States Patent
Buthker et al.

(10) Patent No.: US 9,894,733 B1
(45) Date of Patent: Feb. 13, 2018

(54) STANDALONE LIGHT EMITTING DIODE (LED) CONTROLLER

(71) Applicant: NXP B.V., Eindhoven (NL)

(72) Inventors: Henricus Cornelis Johannes Buthker, Mierlo (NL); Emiliano Mediavilla Pons, Hamburg (DE); Hendrik Boezen, Nijmegen (NL)

(73) Assignee: NXP B.V., Eindhoven (NL)

( * ) Notice: Subject to any disclaimer, the term of this patent is extended or adjusted under 35 U.S.C. 154(b) by 0 days.

(21) Appl. No.: 15/387,798

(22) Filed: Dec. 22, 2016

(51) Int. Cl.
*H05B 33/08* (2006.01)

(52) U.S. Cl.
CPC ..... *H05B 33/089* (2013.01); *H05B 33/083* (2013.01); *H05B 33/0845* (2013.01)

(58) Field of Classification Search
CPC .... H05B 33/02; H05B 33/08; H05B 33/0806; H05B 33/0809; H05B 33/0842; H05B 33/0845; H05B 33/0875; H05B 33/0878; H05B 33/0881; H05B 33/089
See application file for complete search history.

(56) References Cited

U.S. PATENT DOCUMENTS

| | | | | |
|---|---|---|---|---|
| 6,489,937 | B1 | 12/2002 | Ruvinsky | |
| 8,587,217 | B2 | 11/2013 | Melanson | |
| 2014/0292634 | A1* | 10/2014 | Kita | G09G 3/342 345/102 |
| 2016/0293115 | A1* | 10/2016 | Yamashita | G09G 3/3406 |
| 2017/0086270 | A1* | 3/2017 | Buthker | H05B 33/0815 |

* cited by examiner

*Primary Examiner* — Jason M Crawford

(57) ABSTRACT

Embodiments are provided that include a light emitting diode (LED) controller connectable to a matrix of LEDs. A start code is received via at least one input pin, and a selected curve profile is retrieved from a programmable local memory in response to receipt of the start code, wherein the programmable local memory stores a set of curve profiles, each of which is associated with a different start code. A set of coefficients of a polynomial calculator are initialized to a set of values defined in the selected curve profile, wherein the set of values represent a light output curve. A sequence of light intensity values are calculated according to the polynomial calculator, and at least one pulse width modulation (PWM) signal is generated based on the sequence of light intensity values, wherein the at least one PWM signal controls light output of at least one LED.

20 Claims, 8 Drawing Sheets

STANDALONE LIGHT EMITTING DIODE (LED) CONTROLLER

BACKGROUND

Field

This disclosure relates generally to a light emitting diode (LED) controlling circuit, and more specifically, to an LED controlling circuit that utilizes pulse width modulation (PWM) signals.

Related Art

Light emitting diodes (LEDs) are often used as light sources in lighting displays. The light output capability of LEDs has increased greatly over the years, from replacing small incandescent bulbs in consumer electronic devices, to being implemented in headlight assemblies of automobiles. Advantages of using LEDs over incandescent light sources include lower energy consumption, longer lifetime, physical robustness, smaller size, and faster switching, to name a few.

BRIEF DESCRIPTION OF THE DRAWINGS

The present invention may be better understood, and its numerous objects, features, and advantages made apparent to those skilled in the art by referencing the accompanying drawings.

The present invention is illustrated by way of example and is not limited by the accompanying figures, in which like references indicate similar elements, unless otherwise noted. Elements in the figures are illustrated for simplicity and clarity and have not necessarily been drawn to scale.

DETAILED DESCRIPTION

The following sets forth a detailed description of various embodiments intended to be illustrative of the invention and should not be taken to be limiting.

Overview

The present disclosure provides a standalone light emitting diode (LED) controller that is able to individually control the light output of one or more LEDs in a matrix LED display. Such an LED controller is configured to implement a desired light output curve at the one or more LEDs using one or more pulse width modulation (PWM) signals that change the brightness level of the light output at the one or more LEDs. The PWM signals are generated based on a sequence of light intensity values calculated by the LED controller according to a polynomial function that represents the desired light output curve, also referred to herein as a PWM curve. The LED controller implements a polynomial calculator that implements the polynomial function and is configured to calculate a sequence of light intensity values.

Each LED controller is configured to store a plurality of PWM curve profiles locally, where each PWM curve profile includes a set of coefficients that represent a particular PWM curve and each PWM curve profile is associated with a unique start code. When the LED controller receives a start code, processing logic of the LED controller uses the start code to retrieve the associated PWM curve profile from local memory, and initializes the polynomial calculator with the set of coefficients. At least one of the start codes is associated with a stand-by mode, where the LED controller does not calculate light intensity values (e.g., the LEDs remain dark). By calculating the sequence of light intensity values locally, the need for a central microcontroller to provide light intensity values is eliminated.

Further, multiple LED controllers may be coupled in series and may use one or more SYNC lines to coordinate light output effects implemented at the LEDs of multiple matrix LED displays, which also eliminates the need for a central microcontroller to coordinate light output of the matrix LED displays. Such a configuration may be especially beneficial when implementing a same PWM curve in a successively delayed manner to a number of LED channels across multiple matrix LED displays.

Example Embodiments

Figure 1:
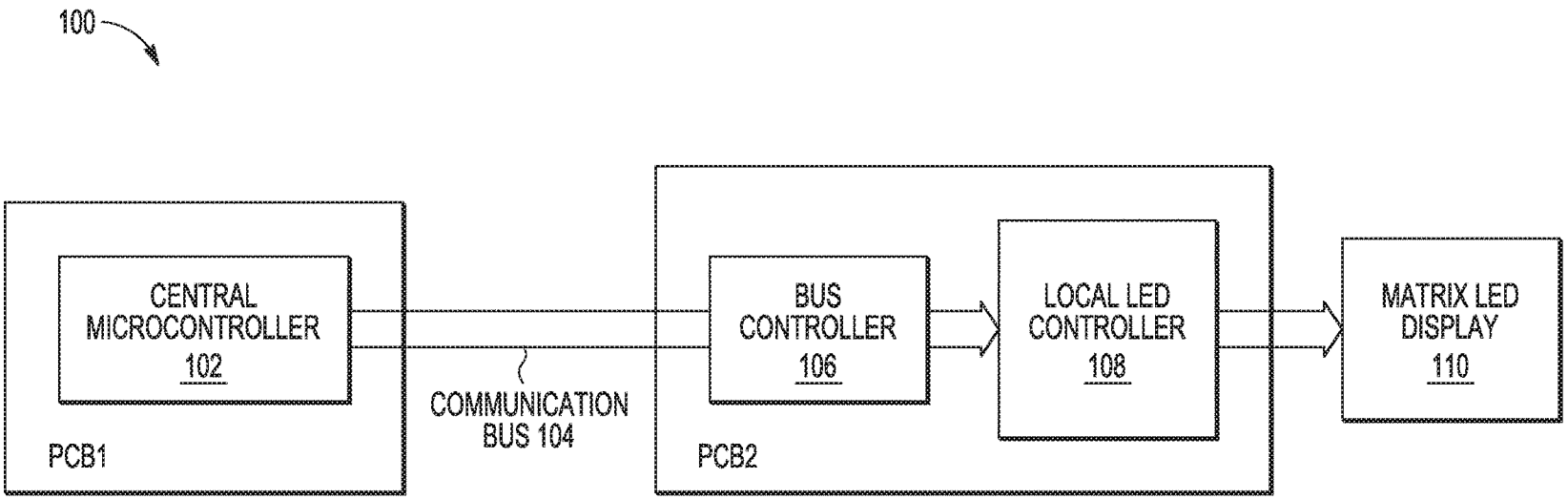
FIG. 1 illustrates a block diagram depicting a known matrix light emitting diode (LED) system.

FIG. 1 illustrates a block diagram depicting a known matrix light emitting diode (LED) system 100. The matrix LED system 100 includes a central microcontroller 102 that is communicatively coupled to a local LED controller 108 by a communication bus 104 and a bus controller 106, which may be a high-speed serial interface, such as a controller area network (CAN) bus. The local LED controller 108 is coupled to a matrix LED display 110, which includes a matrix arrangement of LEDs that may be arranged into a number of channels. In the example shown, the matrix LED system 100 is implemented on two printed circuit boards (PCBs), with the central microcontroller 102 on one PCB and the local LED controller 108 on another PCB.

The central microcontroller 102 may also be communicatively coupled to multiple instances of the local LED controller 108 (e.g., up to 32 LED controllers, which control a total of 384 LED channels), where each local LED controller 108 is communicatively coupled to a respective matrix LED display 110. The multiple instances of the local LED controllers 108 may be coupled to the central microcontroller 102 via the same communication bus 104.

The matrix LED system 100 may be implemented as a headlight system for an automobile. The central microcontroller 102 is configured to coordinate overall light output by the matrix LED displays 110 via each local LED controller 108, such as by transmitting a light intensity value to an LED controller 108 that describes a brightness level that should be implemented at an LED. If the central microcontroller 102 were configured to directly control the LEDs in every channel (e.g., up to 384 channels), the central microcontroller 102 would need to transmit a light intensity value to every channel on a periodic basis. As an example, if the light intensity values are 12 bits wide and are transmitted every 5 ms on each of the 384 channels (e.g., at an example update rate of 200 Hz), a bandwidth of at least 921.6 kbit/sec would be required, which is an exceedingly large bandwidth over the communication bus 104. The required bandwidth doubles to 1.843 Mbit/sec for an update rate of 400 Hz. Further, this bandwidth is calculated for a basic data rate, without address bits and error reduction bits. A real-world required bandwidth may be up to three times larger than the basic data rate, while the maximum data rate of an automotive qualified CAN interface is only 1 Mbit/sec.

Figure 2:
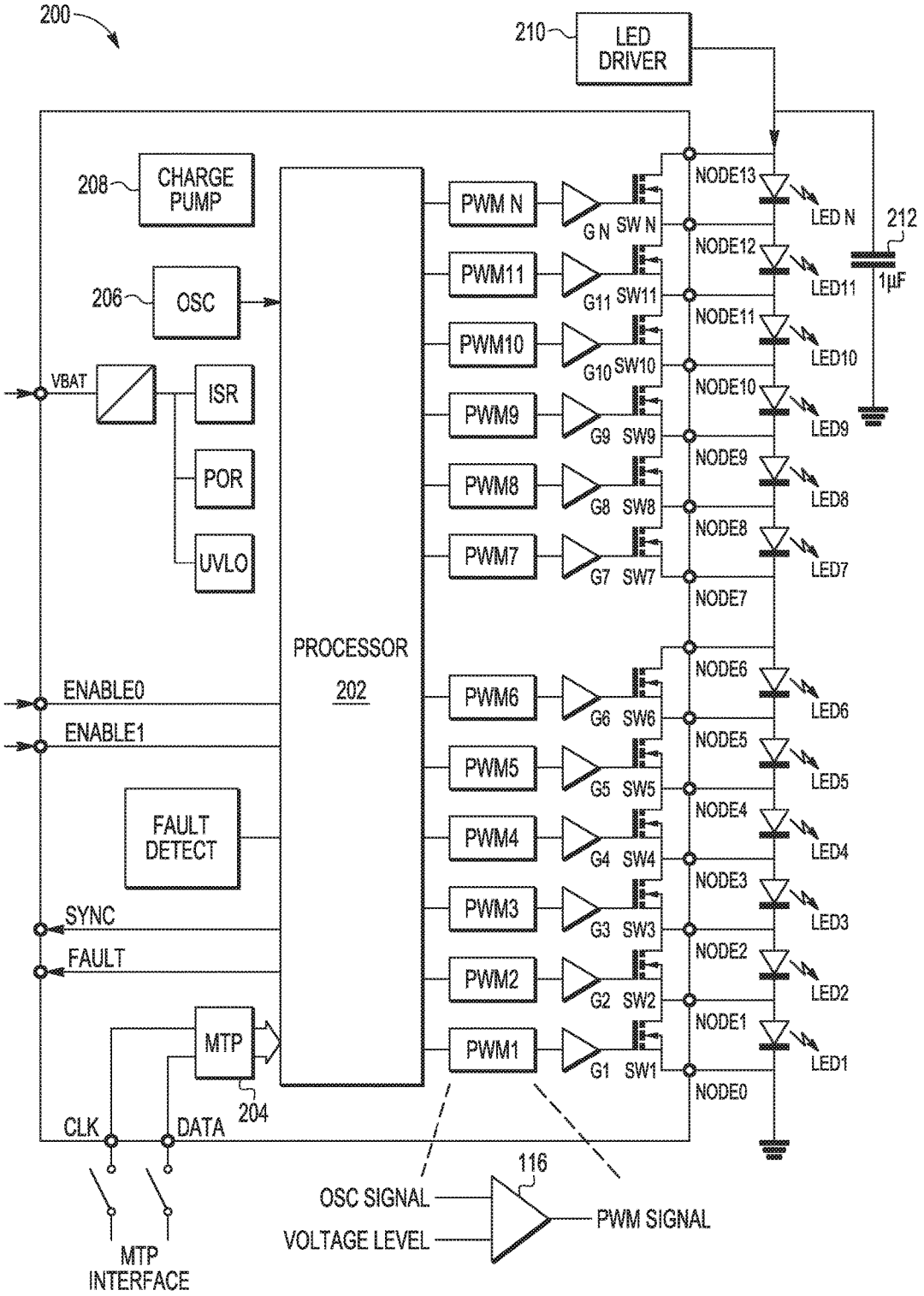
FIG. 2 illustrates a block diagram depicting an example standalone LED controller system in which the present disclosure is implemented, according to some embodiments.

FIG. 2 illustrates a block diagram depicting an example standalone LED controller system 200 in which the present disclosure is implemented. The standalone LED controller is configured to control light output of one or more LEDs in a matrix LED display, without receiving light intensity values from a central microcontroller. Instead, the standalone LED controller is configured to receive an M bit start code on an M number of input lines, where M is an integer of one or greater, which identifies a stored curve profile to be used to control the light output at LEDs in the matrix LED display. The standalone LED controller eliminates the need for the central microcontroller, as well as the communication bus and bus controller, which reduces complexity of the system, such as by eliminating software, integrated circuits, and required timing constraints for communication over a high-speed serial interface like a CAN bus. Further, in some embodiments, a number of standalone LED controllers may be coupled to one another in a serial manner. The standalone LED controllers may be configured to communicate with one another using a number of dedicated pins, as further discussed below.

Components of the standalone LED controller system 200 (or simply LED controller 200) include a processor 202, a multiple time programmable (MTP) memory 204 communicatively coupled to the processor 202 and configured to store a plurality of light output curve profiles (further discussed below), and an oscillator 206 configured to provide an oscillating signal (such as a digital saw-tooth signal) at a frequency in the range of 200 to 1000 MHz, which may be used as the clock signal for the processor 202. The processor 202 has an M number of input lines that are configured to receive one of a possible 2M start codes, where M=2 in the example shown in FIG. 2 (labeled as ENABLE1 and ENABLE0), although M may be different values in other embodiments, such as 1. The processor 202 also has a dedicated fault output line (labeled as FAULT) for communicating detection of faults in the LEDs or on the LED controller 200, and a dedicated sync output line (labeled as SYNC, also referred to as a synchronization line) that can be used to connect multiple LED controllers 200 together and synchronize light output effects of LEDs. In other embodiments, the processor 202 may also include a dedicated sync input line. The fault output line is discussed below in the present discussion of FIG. 2, while the input lines and the sync line(s) are discussed further below in connection with FIG. 3. MTP memory 204 is programmable using a serial interface, such as a local short-distance peripheral communication interface like an inter-integrated circuit (I2C) interface. In the example shown, the serial interface includes two lines, a clock line (labeled as CLK) and a data line (labeled as DATA). The serial interface is used to store the curve profiles in MTP memory 204 at a time before operation of LED controller 200. Each curve profile is associated with a unique value of the start code values. In some embodiments, the MTP memory 204 is implemented as part of a same integrated circuit that includes the processor 202. In other embodiments, the processor 202 is coupled to MTP memory 204 via a local short-distance peripheral communication bus, where the processor 202 and MTP memory 204 are implemented on a same printed circuit board (PCB), shown as a square surrounding the components of standalone LED controller 200. Input and output pins on the PCB are illustrated as dark circles aligned at the edge of the PCB.

Components of the LED controller 200 also include an N number of pulse width modulation (PWM) generators (shown as PWM1-PWM N) that are coupled to the processor 202 by an N number of output lines, an N number of gate drivers (shown as G1-G N) that are each coupled to an output of a respective PWM generator, and an N number of switches (shown as SW1-SW N) that each have a control electrode coupled to an output of a respective gate driver. Each switch is coupled in parallel with a respective LED of the matrix LED display, as discussed below. A charge pump 208 is also coupled as a power supply voltage to each gate driver, where the charge pump 208 may be implemented as a DC (direct current) to DC converter.

In the example shown, the matrix LED display includes an N number of LEDs (shown as LED1-LED N) arranged in a matrix arrangement and connected to the nodes of switches SW1-SW N (shown as NODE0-NODE13), where the switches may be implemented using suitable p-n junction diodes that emit light (e.g., visible light) when activated. The matrix arrangement of LEDs may be in a series arrangement, where a number of LEDs are coupled end to end in a string (e.g., anode of one LED to cathode of the next LED), or in a parallel arrangement, where a number of LEDs are coupled in parallel (e.g., anode of one LED to anode of next LED). In the embodiment shown, the N number of LEDs are connected in series as a string of LEDs, with an anode of one LED coupled to a cathode of a next LED. The first LED in the string (LED1) has a cathode coupled to ground and a last LED in the string (LED N) has an anode coupled to an LED driver 210 that is configured to provide a constant current to the string. It is noted that in a parallel arrangement, the LEDs are supplied from an LED driver 210 that is implemented as a voltage source, rather than a current source. The LED driver 210 may be implemented as a DC to DC converter. It is noted that the number N is an integer equal to or greater than one, where the N number of LEDs is limited in order to limit the maximum voltage applied to the string of LEDs to safe voltage levels. In the example shown, N equals 12 to limit the maximum string voltage to levels below 60V, although other values of N may be used in other implementations to remain within other safe voltage levels. Also, the N number of LEDs may be divided into substrings, such as two substrings of 6 LEDs (e.g., LED1-LED6 form a substring, LED7-LED N form another substring, and so on).

In the embodiment shown, switches SW1-SW N are implemented using n-type transistors, such as a MOSFET (metal-oxide-semiconductor field effect transistor), although other suitable types of transistors or suitable switching elements may be utilized. A first current electrode (such as a drain electrode) of each switch is coupled to an anode of a respective LED and the second current electrode (such as a source electrode) of each switch is coupled to a cathode of the respective LED. Each switch also has a control electrode (such as a control gate electrode) coupled to the output of a respective gate driver. The signal provided by the gate driver closes the switch (e.g., makes the transistor conductive) or opens the switch (e.g., makes the transistor nonconductive).

When the switch is opened, current flows through the LED, which turns on and emits light. By closing the switch, the LED is shorted, which turns off and no longer emits light.

In order to change the perceived light output of the LED, the switch is quickly opened and closed using a pulse width modulation (PWM) signal that is output by the PWM generator and delivered to the switch control electrode by the gate driver. As shown in the inset at the bottom of FIG. 2, each PWM generator includes a comparator 216 having an input coupled to receive an oscillating signal (OSC signal) and an input coupled to an output line from the processor 202. The oscillating signal may be a divided version of the clock signal output by the oscillator 206, as discussed below. The processor 202 is configured to implement a calculator that in turn is configured to calculate light intensity values based on a selected light output curve profile retrieved from MTP memory 204. Each light output curve profile includes information that represents a light output curve, which is also referred to as a PWM curve. Each PWM curve describes a sequence of brightness levels of the light output of an LED over time, where the brightness levels each indicate an intensity of the light output of an LED, relative to a minimum light output and a maximum light output of the LED (e.g., from 0% to 100% brightness or light intensity). The calculated light intensity values, which are calculated in a sequential or serial manner, correspond to a sequential set of points on the selected PWM curve, where each light intensity value indicates a respective brightness level. Curve profile information and calculation of the light intensity values are further discussed below in connection with FIG. 4.

The processor 202 then outputs a sequence of voltage levels, each voltage level corresponding to one of the sequence of (calculated) light intensity values. Each voltage level corresponding to each light intensity value is output at an update rate determined by the PWM frequency. For an example PWM frequency of 200 Hz, the voltages are output at an update rate of every 5 ms (which indicates the light intensity values should also be calculated at a rate at least as fast as the update rate). For a given light intensity value, the processor 202 may output the same voltage level to every comparator (all LEDs have the same light output), or may output a different voltage level to each comparator (e.g., the LEDs each have a delayed light output). Each comparator 216 outputs a PWM signal (such as a square wave signal with variable duty cycle) based on the comparison of the oscillating signal and the received voltage level, where the duty cycle of the PWM signal changes based on the received voltage level corresponding to the light intensity value. Each gate driver is an amplifier configured to deliver the digital PWM signal as an analog control signal to the switches. In some embodiments, each gate driver is a power amplifier configured to deliver a high-current PWM signal to the switches.

The duty cycle of the PWM signal is the fraction or percentage of one period (or a complete on-and-off cycle) in which the PWM signal is active. For example, 100% duty cycle provides an active signal for the entire period, and 0% duty cycle provides an inactive signal for the entire period. The duty cycle of the PWM signal controls the percentage of the time the switch is closed and the LED is shorted and off. By increasing the duty cycle, the percentage of time that the switch is closed is increased, which reduces the time-averaged current through the LED and results in reducing the time-averaged brightness or light intensity of the light output at the LED. Similarly, by decreasing the duty cycle, the percentage of time that the switch is closed is decreased, which increases the time-averaged current through the LED and results in increasing the time-averaged brightness or light intensity of the LED's light output. It is noted that use of the term "brightness" herein indicates time-averaged brightness or time-averaged light intensity of the light output of an LED.

In the embodiments provided herein, a brightness resolution of 12 bits is implemented, which defines 4096 different brightness or light intensity levels between 0% brightness (full dark achieved by a duty cycle of 100%) and 100% brightness (full light achieved by a duty cycle of 0%), although other resolutions may be utilized in different embodiments. The frequency of the oscillating signal (OSC signal) provided to the PWM generators is a version of a signal output by the oscillator 206 (such as a clock signal) that is divided at least by the total number of brightness levels implemented by the brightness resolution, which is also referred to as a PWM frequency. It is noted that the on/off switching of an LED is invisible to the human eye using a PWM frequency that is within the target range of 200 to 1000 Hz, but results in a perceivable transition from one time-averaged level of brightness to another. For example, a 200 MHz clock signal is internally divided to get a 1000 kHz signal, which is then divided by the brightness resolution, or 4096, to achieve a PWM frequency of 244 Hz.

In the embodiment shown, the N number of PWM generators, gate drivers, and switches are coupled to form an N number of branches or channels, where each channel is coupled to an individual LED. The LED controller 200 is configured to control each channel in an individual manner by providing individual PWM signals to those channels. The LED controller 200 is also configured to provide a same PWM signal to groups of one or more channels, to control those channels in a collective manner. In some embodiments, the matrix LED display may further include a string of several LEDs in a given channel (e.g., 12 channels each having a string of 3 LEDs), allowing the LED controller 200 to control the several LEDs in a single channel as a group. It is noted that the matrix LED display in such embodiments may utilize a different total number of LEDs arranged in one or more strings (e.g., 8 channels each having a string of 4 LEDs), depending on the maximum safe voltage levels utilized for that matrix LED display. In some embodiments, the LEDs may be in a parallel arrangement, with switches or current sources in series with each LED.

Also in the embodiment shown, a capacitor 212 is coupled between the output of the LED driver 210 and ground to minimize any voltage fluctuations that may occur, which in turn minimizes any perceptible light flicker in the light output of the LEDs. Optionally, a current limiting device may also be included in FIG. 2 (not shown), coupled between ground and the anode of the last LED (LED N) in the string of LEDs (also referred to as being coupled in anti-parallel between the top of the string of LEDs and ground) to protect the LED controller 200 by limiting any extraneous current that may occur at the nodes of the switches (e.g., due to a short circuit of one of the LEDs at the bottom of the string of LEDs, causing a large negative voltage at the nodes of the switches).

Also in the embodiment shown, a battery connection or terminal (labeled VBAT) provides a voltage supply connection for the LED controller 100. The battery connection is also coupled to an internal supply regulator (labeled as ISR) configured to regulate the battery voltage (e.g., avoid voltage spikes and drops that may damage the LED controller) and provide a digital power supply used by the LED controller 100. The battery connection is also coupled to a power on reset circuit (labeled as POR) configured to detect when the digital power supply reaches a POR threshold, such as 1.4V. When battery voltage is supplied to the battery connection, POR circuit prevents the LED controller system from initializing until the POR threshold is met. Once POR threshold is met, the POR circuit releases the system, which begins to initialize itself (as long as the digital power supply is available). The battery connection is also coupled to an under-voltage lock out circuit (labeled as UVLO) configured to turn off the voltage supply in the event the voltage supply falls below an operational voltage threshold in order to prevent damage to the LED controller.

Additionally, the LED controller 200 includes a fault detector (labeled as FAULT DETECT) that is configured to determine various fault states. For example, fault detector can determine whether an LED has failed, such as by including an open circuit detector configured to detect whether the LED is damaged in such a way as to make it an open circuit, also referred to as an open circuit failure. For example, the maximum forward voltage of an LED may be 4V or 4.5V and the maximum breakdown voltage of a PWM switch is 20V. The open circuit detector includes a comparator that is configured to detect whether the voltage drop over the LED is greater than 4.5V in order to avoid reaching the breakdown voltage of the switch. In some embodiments, an open circuit voltage threshold may be set at 6V±1V. The open circuit may only be detected when the respective switch coupled in parallel with the LED is open. Upon detection of an open circuit (OC), an OC error bit or flag may be set. In some embodiments, a fault code associated with an open circuit fault may be serially output on the dedicated fault output line (labeled as FAULT). In other embodiments, a general fault code (such as a single bit) may be set to indicate that some error has occurred. Also upon detection of the open circuit, the switch in parallel with the faulty LED is closed.

The fault detector may also include a short circuit detector configured to detect whether the LED is damaged in such a way as to make it a short circuit, also referred to as a short circuit failure. The switch voltage, when closed (and the switch is conducting), is determined by the resistance of the switch when in saturation or fully on (also referred to as Rds(on)), current, and temperature. The short circuit detector includes a comparator that is configured to detect whether this voltage is less than 2V. In some embodiments, a short circuit voltage threshold may be set at 1V±0.5V. The short circuit may only be detected when the respective switch coupled in parallel with the LED is open. Upon detection of a short circuit (SC), an SC error bit or flag may be set. In some embodiments, a fault code associated with a short circuit fault may be output on the fault output line, or a general fault code may be output in other embodiments. Also upon detection of the short circuit, the switch in parallel with the faulty LED is closed.

The fault detector may also include a temperature detection circuit that indicates whether operating temperature exceeds a temperature threshold, also referred to as a temperature excursion. The temperature detection circuit may include a thermistor, which is a type of resistor whose resistance is dependent on temperature. If the detected temperature of the LEDs or the switches or some other component of the LED controller (e.g., battery connection VBAT, processor 202, charge pump 208, LED driver 210, and the like) exceeds the temperature threshold, a temperature error bit or flag may be set. For example, the temperature detection circuit may detect whether the operating temperature exceeds 130 degrees Celsius.

As noted above, the processor 202 and memory 204 of LED controller 200 are part of a single integrated circuit in some embodiments. Examples of integrated circuit components include but are not limited to: logic, analog circuitry, sensor, a MEMS device, MOSFET devices, a standalone discrete device such as a resistor, inductor, capacitor, diode, power transistor, a combination of the integrated circuit component types listed above, or may be another type of microelectronic component. The circuitry described herein (such as the processor circuitry and memory circuitry) may be implemented on a semiconductor substrate, which can be any semiconductor material or combinations of materials, such as gallium arsenide, silicon germanium, silicon-on-insulator (SOI), silicon, monocrystalline silicon, the like, and combinations of the above.

Figure 4:
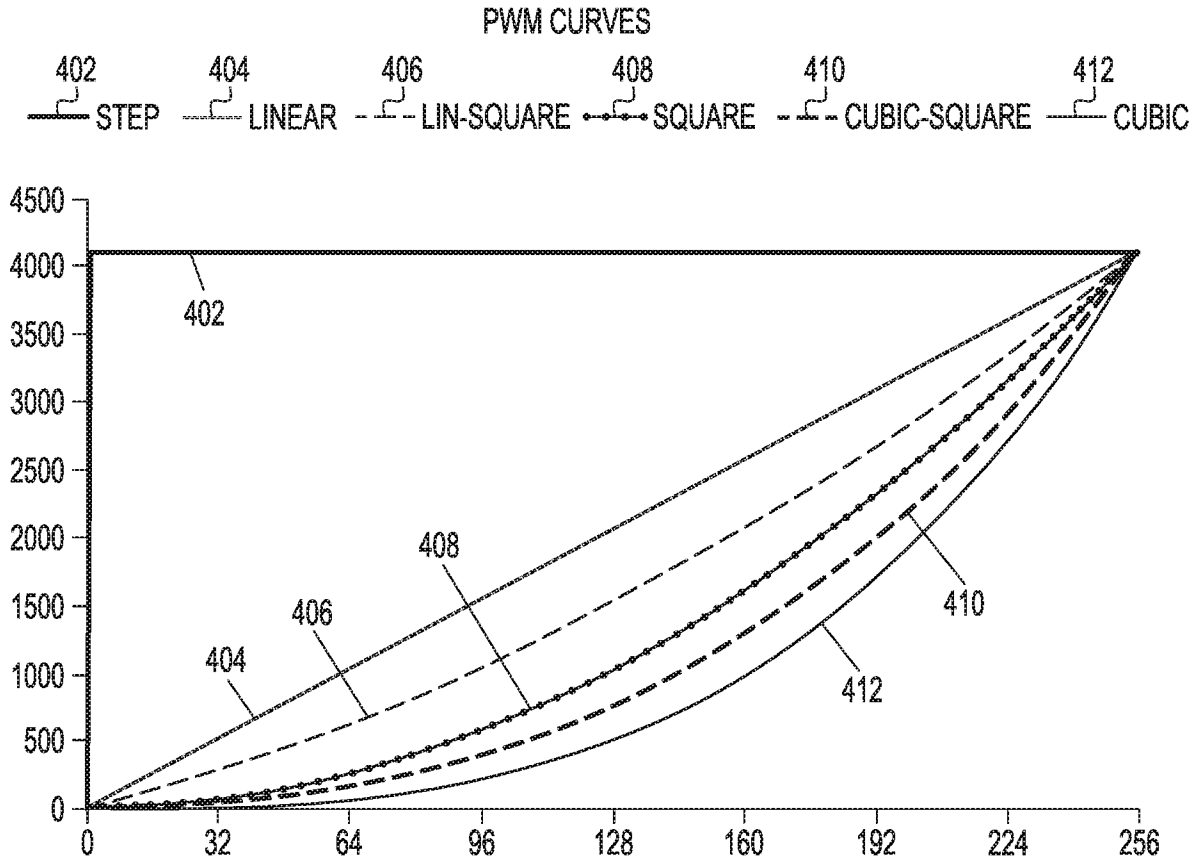
FIG. 4 illustrates example PWM curves for implementing PWM signals to control LEDs, according to some embodiments.

FIG. 4 illustrates example pulse width modulation (PWM) curves used to implement PWM signals for controlling the brightness of the light output of one or more LEDs. As noted above, each PWM curve is a light output curve, which describes a sequence of brightness levels of the light output of an LED (or light intensity values) over some amount of time.

The vertical axis of FIG. 4 represents brightness or light intensity levels. In the embodiment shown, a 12 bit resolution is implemented, achieving a maximum light intensity value of 4096. A light intensity value of 0 indicates a light output of 0% brightness (or full dark) and a light intensity value of 4096 indicates a light output of 100% brightness (or full light). The horizontal axis of FIG. 4 is divided into 256 steps (for an 8 bit step resolution) identified by a sequential set of index numbers, where a light intensity value corresponds to each index number, although a different number of steps (or step resolution) may be implemented in other embodiments. In other words, each PWM curve can be represented by a sequence of 256 light intensity values.

As also noted above, a voltage level corresponding to each light intensity value is output at an update rate determined by the PWM frequency. In this manner, the index numbers also represent (uniform) units of time, based on the period of the PWM frequency. For example, for a PWM frequency of 200 Hz, a light intensity value is output every 5 ms, indicating the PWM curve is completed after 256 steps×5 ms=1.28 sec. For a PWM frequency of 400 Hz, each unit of time represents 2.5 ms, indicating the PWM curve is completed after 256 steps×2.5 ms=0.64 sec.

The example PWM curves shown in FIG. 4 include:

a step function 402, which may also be referred to as immediately ON;

a linear function 404, which may have a constant or linearly increasing duty cycle;

a linear-square function 406;

a square function 408;

a cubic-square function 410; and a cubic function 412.

It is noted that any shaped light output curve is possible if the entire sequence of 256 light intensity values are stored in local memory. However, storage of such a curve (utilizing a brightness resolution of 12 bits) would require 12 bits×256 light intensity values=3072 bits per curve. To store 3 curves, a number of 3×3072 bits=9216 bits is required. However, MTP memory 204 may be implemented having a size of 1 kb.

Each PWM curve can be described by a polynomial function, where the light intensity values of the PWM curve are defined as a function of the index number. A generic equation of the polynomial function is provided as:

$$\mathrm{PWM}(x)=Ax^3+Bx^2+Cx+D \quad \text{Eq. 1}$$

Differently-shaped PWM curves are described by the polynomial function implementing different values of polynomial coefficients A, B, C, and D. In other words, each PWM curve can be represented by a different set of coefficients. In the embodiments described herein, the polynomial function may be up to and including a third-order polynomial, also referred to as the polynomial function having a polynomial degree of three or less, which adequately describes a PWM curve for 12 bit brightness resolution.

To reduce the amount of storage space needed to implement a light output curve, the LED controller 200 is configured to locally store a set of four polynomial coefficients, A, B, C, and D, which represent the light output curve or PWM curve. The coefficients are stored as part of the light output curve profile for the given PWM curve in MTP memory 204, where each coefficient is 12 bits wide. Storage of such a PWM curve profile would require 12 bits×4 coefficients=48 bits or 6 bytes. For 3 curve profiles, a number of 3×48 bits=144 bits is stored in MTP memory 204, which is a significant reduction of required storage space by a factor of 64. The LED controller 200 also implements a polynomial calculator that is configured to calculate the light intensity values based on the polynomial function. The polynomial calculator is further discussed below in connection with FIG. 6A.

It is noted that a scaling or shift parameter S is also implemented herein, which is used to scale the PWM curve in the horizontal direction, or change the total number of steps over which the PWM curve extends:

$$PWM(x) = A\frac{x^3}{S^3} + B\frac{x^2}{S^2} + C\frac{x}{S} + D \quad \text{Eq. 2}$$

Figure 5B:
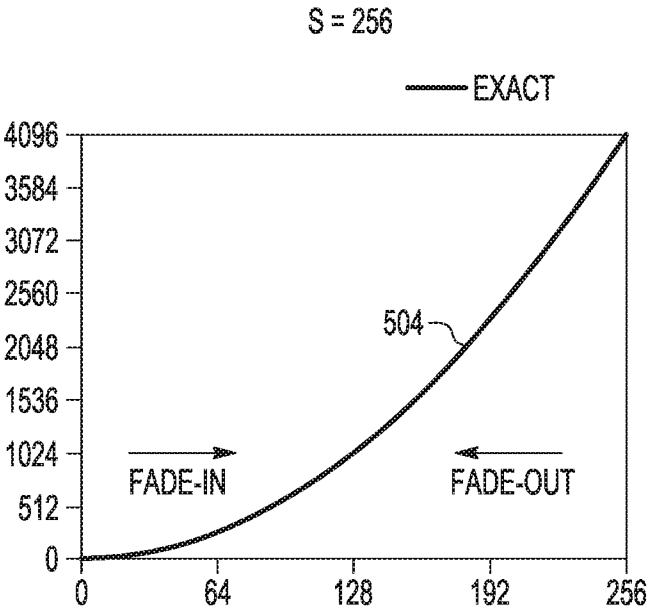
FIGS. 5A and 5B illustrate example PWM curves implemented using different scaling parameters, according to some embodiments.
Figure 5A:
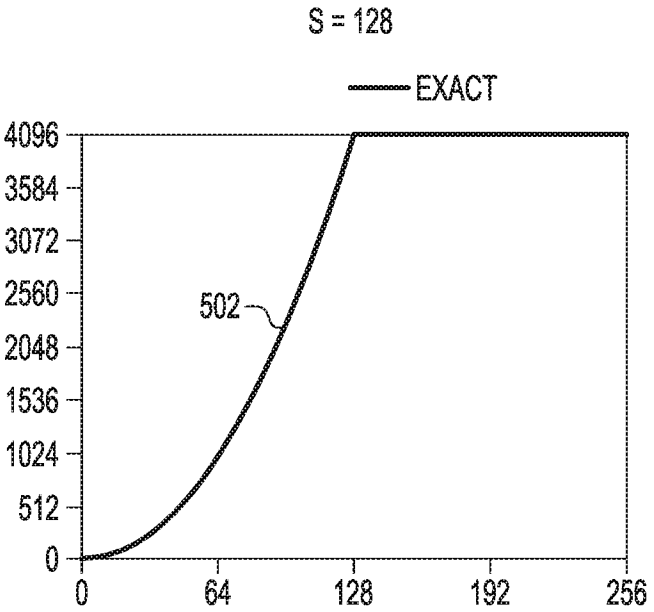

For example, a scaling parameter S=256 (indicating 256 steps) is used as a default for the PWM curves shown in FIG. 4. An implementation of a PWM curve having a scaling parameter S=128 is shown in FIG. 5A, with a side-by-side comparison of another implementation of the same PWM curve having a scaling parameter S=256 shown in FIG. 5B. The scaling parameter S=128 is half as large as the default value of S=256, indicating that the PWM curve in FIG. 5A extends over half as many steps as the PWM curve in FIG. 5B. In other words, the curve 502 shown in FIG. 5A can be described with a fewer number of light intensity values, as compared with the number of light intensity values that describe the curve 504 in FIG. 5B (e.g., 128 light intensity values describing curve 502, compared with 256 light intensity values describing curve 504). In the embodiment shown, the last light intensity value may continue to be provided for the remainder of the (default) 256 steps, although a different light intensity value may be provided in other embodiments.

An S parameter that is smaller (e.g., S=128) than the default S parameter indicates that the PWM curve is divided into a smaller number of steps (e.g., scales down the PWM curve), where the PWM curve can be described by a fewer number of light intensity values (e.g., half as many values). Since the light intensity values of the PWM curve are sequentially provided at the update rate defined by the PWM frequency, the completion time of the PWM curve is decreased (e.g., the PWM curve is output faster). For example, the S parameter of 128 indicates that the PWM curve in FIG. 5A is completed over 128 steps, which results in a completion time of 128 steps×5 ms=0.64 sec (for a PWM frequency of 200 Hz). By contrast, the PWM curve in FIG. 5B is completed over 256 steps, which is equivalent to 256 steps×5 ms=1.28 sec. Example values of the S parameter include 256, 128, 64, 32, 16, 8, 4, and 2, where the S parameter can be indicated by a 3 bit wide value to select one of the 8 options. An S parameter value may also be stored in each curve profile in MTP memory 204, or may be set to a default value used for every curve profile implementation (e.g., the S parameter value is stored in one location in MTP memory 204 or is configured in the calculator used to calculate the light intensity values). In the embodiments discussed herein, a maximum value of the S parameter is 256, although different maximum values may be utilized in other embodiments (e.g., a maximum value of 512 or 1024, which would require a 4 bit wide value to select one of the 9 or 10 options).

In some embodiments, a portion of the PWM curve may be implemented, over a range of index numbers from a starting (referred to as START) index number to a stopping (referred to as a STOP) index number. For example, in FIG. 5B, a portion of the PWM curve from a START index number of 64 to a STOP index number of 192 may be implemented at the LED curves, rather than the entire PWM curve from 0 to 256. In some embodiments, the desired START and STOP index numbers for a given PWM curve may also be stored in each curve profile, or a default START (e.g., 0) index number and a default STOP (e.g., 256) index number may be stored.

It is noted that light intensity values calculated based on the PWM curve shown in FIG. 5B start at a small light intensity value at index number 0 and end at a larger light intensity value at index number 256. Such a PWM curve implements a fade-in effect, where the brightness of the light output of the LED is increasing over time. The same PWM curve can also be used to implement a fade-out effect, where the brightness of the light output of the LED is decreasing over time. For example, the light intensity values calculated based on the PWM curve in FIG. 5B start at a large light intensity value at index number 256 and end at a smaller light intensity value at index number 0. In other words, the light intensity values can be provided in a sequence order according to increasing index numbers to implement a fade-in effect (as indicated in FIG. 5B by the directional arrow pointing from left to right, labeled FADE-IN), and can be provided in a reverse sequence order according to decreasing index numbers to implement a fade-out effect (as indicated in FIG. 5B by the directional arrow pointing from right to left, labeled FADE-OUT).

In some embodiments, the fade-in effect or fade-out effect is indicated by a fade directional indicator, which may be stored in a light output curve profile to indicate whether a selected PWM curve should be used to implement a fade-in effect or a fade-out effect at the LEDs. In other embodiments, a default fade directional indicator may be implemented, such as by storing a default value of the fade directional indicator in memory (e.g., at one location in memory 204 or in each curve profile stored in memory 204), or the polynomial calculator may be hardwired to utilize the default fade directional indicator. In embodiments that implement a fade directional indicator, a fade directional indicator that indicates a fade-in effect should be implemented is used to provide the polynomial calculator with a set of increasing index numbers, and a fade directional indicator that indicates a fade-out effect should be implemented is used to provide the polynomial calculator with a set of decreasing index numbers, as further discussed below in connection with FIG. 6A. In embodiments that also have a START and STOP index number stored in the curve profile, the processor 202 initializes the polynomial calculator with the stored START and STOP index numbers according to the fade directional indicator, ensuring the proper calculations are made. For example, if a fade directional indicator indicates a fade-in effect, the processor uses the smaller one of the stored START and STOP index numbers as the polynomial calculator's START index number and the larger one of the stored START and STOP index numbers as the polynomial calculators' STOP index number. Similarly, if a fade directional indicator indicates a fade-out effect, the processor uses the larger one of the stored index numbers as the calculator's START index number and the smaller one of the stored index numbers as the calculator's STOP index number.

As noted above, the PWM curve of FIG. 5A reaches full brightness at index number 128. The PWM curve is then followed by a step curve indicating that the LED is on for some amount of time equivalent to a specified number of steps. In the example shown in FIG. 5A, the LED remains on for an additional 128 steps, from index number 128 to index number 256. This time, referred to as LED ON time, may be stored in the curve profile. Similarly, if the PWM curve shown in FIG. 5A is used to implement a fade-out effect, the PWM curve would reach 0 brightness at index number 128, and then be followed by a step curve indicating that the LED is off for some amount of time. This time, referred to as LED OFF time, may also be stored in the curve profile. In some embodiments, the LED ON time indicates that the last calculated light intensity value is used to keep the LED on for the LED ON time, which may be less than 100% brightness. The LED ON and LED OFF times may provide an LED on or off duration time up a maximum number of steps 256.

Figure 3:
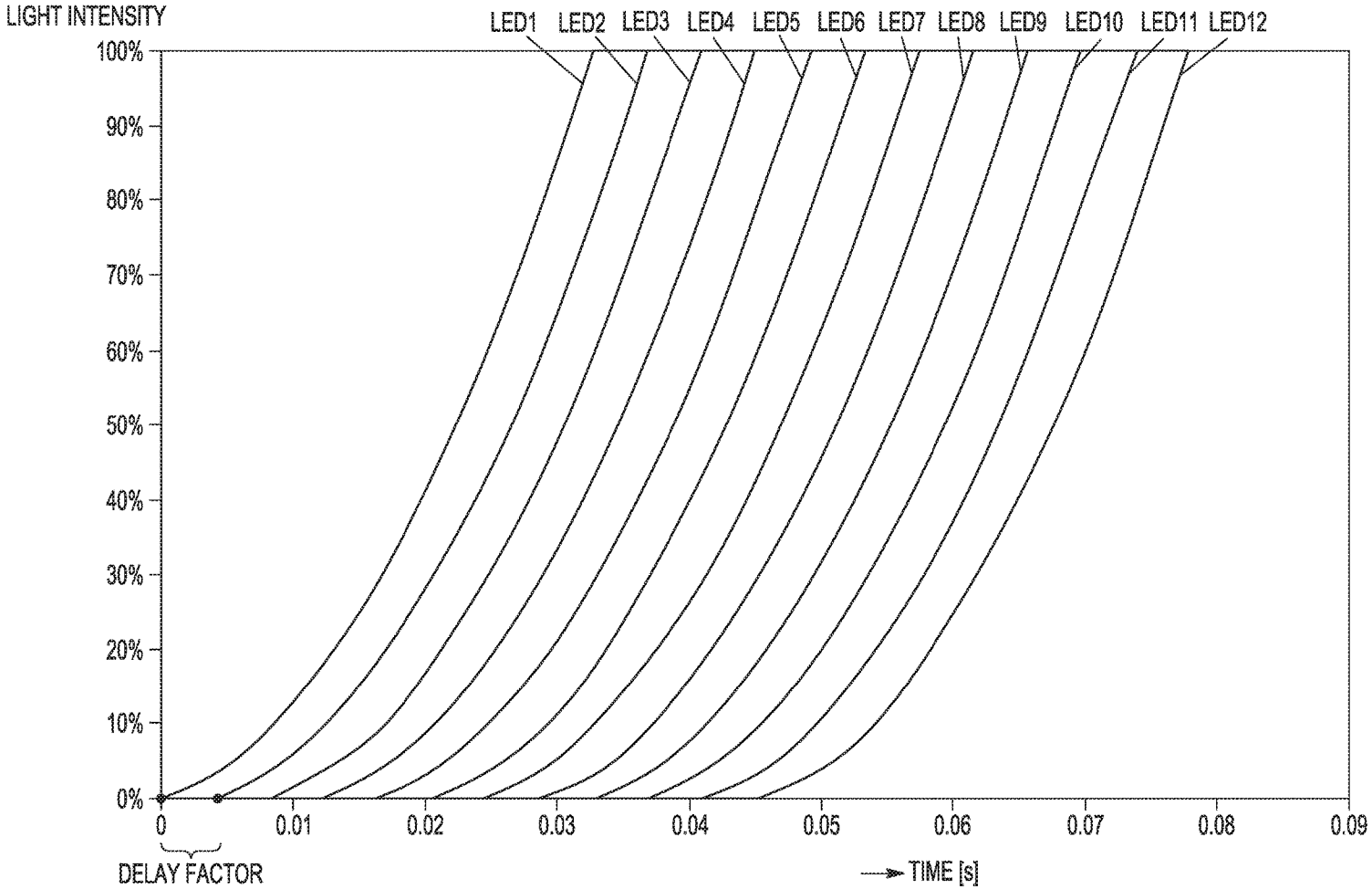
FIG. 3 illustrates an example delay factor for implementing a delayed version of a pulse width modulation (PWM) curve at a number of LEDs.

It is also noted that each PWM curve may be implemented at the LEDs in a collective manner, where every channel implements the same PWM curve at the same time, or in an individual manner where each channel implements the same PWM curve at successively delayed times. FIG. 3 illustrates an example PWM curve being implemented in a number of LED channels at successively delayed times. As shown, the same PWM curve is implemented for each of 12 LED channels, labeled as LED1-LED12 at the top of the diagram. As noted above, the processor 202 is configured to output a sequence of voltage levels corresponding to a sequence of light intensity values calculated by the polynomial calculator. The processor 202 provides the first voltage level of the sequence of voltage levels to a PWM generator of the first LED channel at a time 0, which generates a PWM signal to begin implementing the PWM curve at the one or more LEDs of the first LED channel. The processor 202 provides the remainder of the sequence of voltage levels at an update rate equivalent to the PWM frequency (e.g., every 5 ms for a PWM frequency of 200 Hz) to the PWM generator.

The processor 202 then provides the first voltage level of the sequence of voltage levels to a PWM generator of the second LED channel at a delayed time after time 0, where the amount of time between time 0 and the delayed time (also referred to as an amount of delay time) is defined by the delay factor (labeled as DELAY FACTOR). The processor 202 provides the remainder of the sequence of voltage levels at the update rate to the PWM generator. The processor 202 then provides the first voltage level of the sequence of the voltage levels to a PWM generator of the third LED channel at another delayed time after the first voltage level is provided to the second LED channel, as defined by the delay factor, and so on until the sequence of voltage levels have been provided to each of the remaining LED channels. In this manner, the delay factor can be used to implement a "wiping" motion or light output effect at the LEDs. In some embodiments, each curve profile also stores a channel directional indicator, which indicates the direction of the wiping motion, such as a first direction from a first LED to a last LED (e.g., from LED1 to LED N), or in an opposite second direction from the last LED to the first LED (e.g., from LED N to LED1). The channel directional indicator may be a single bit that indicates which direction is implemented. Further, a subset of the channels may be used to implement the wiping motion, which may also be stored in each curve profile as a channel subset indicator. The channel subset indicator may indicate 144 different possible combinations of 12 channels being used.

The delay factor may indicate an amount of delay time equivalent to a number of steps of a curve. Since 256 is a maximum number of steps, an 8 bit wide delay factor value can be used to indicate a minimum amount of delay time of 0 (e.g., no delay), or an amount of delay time equivalent to a single step (e.g., 1) up to a maximum amount of delay time equivalent to 255 steps. A single delay factor is used to successively delay the PWM curve to each of the LED channels.

Figure 8:
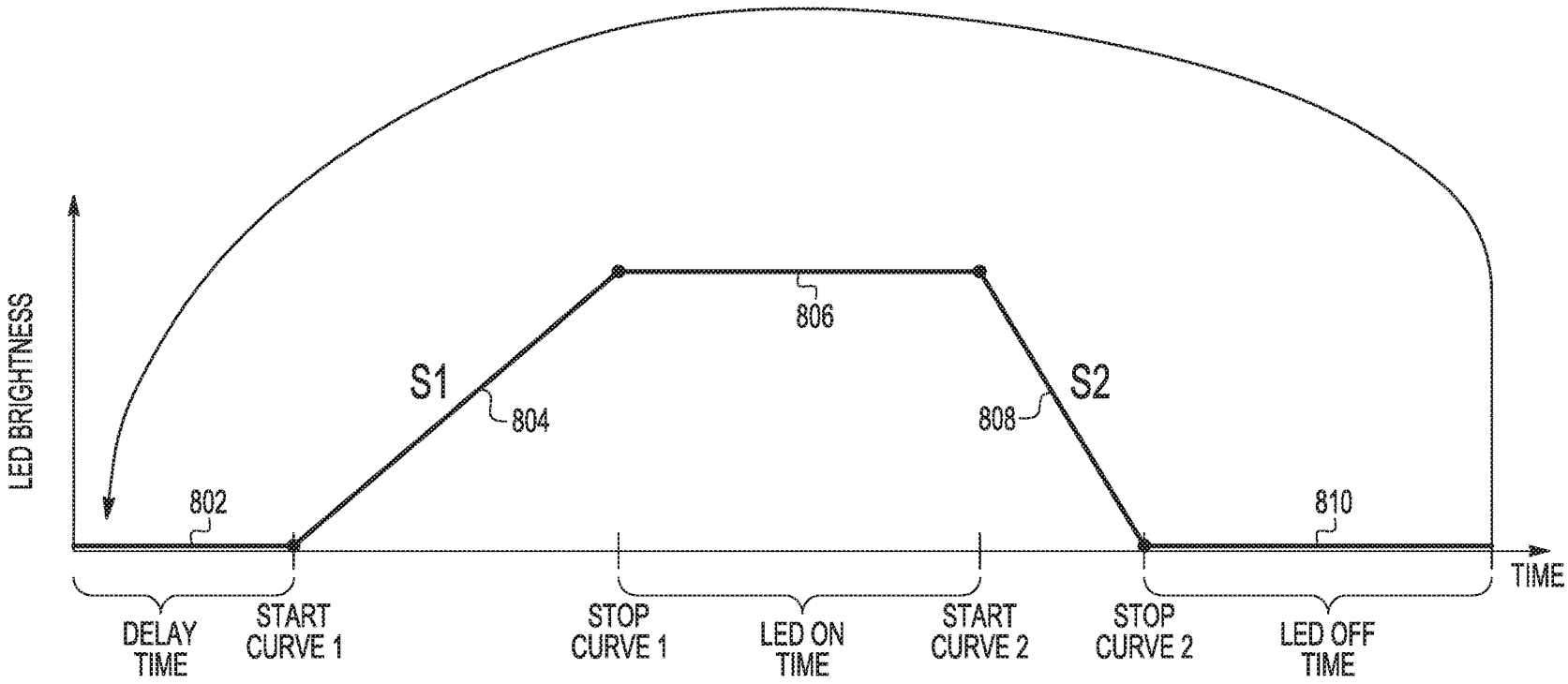
FIG. 8 illustrates an example stitched PWM curve, according to some embodiments.

In some embodiments, a number of PWM curves may be "stitched" together to form a "larger" implemented PWM curve. For example, FIG. 8 shows a stitched PWM curve that is implemented for a given channel, which includes portions of a first curve, Curve 1, and a second curve, Curve 2, each of which have a separate curve profile. A first portion 802 of the stitched PWM curve implements an amount of delay time in the channel before Curve 1 is implemented. A next portion 804 of the stitched PWM curve begins immediately after the delay time, labeled as START Curve 1. The portion 804 implements a portion of Curve 1, from a START index number to a STOP index number, at a scaling factor of S1. The portion 804 may include part of, or all of, Curve 1. A next portion 806 of the stitched PWM curve implements the LED ON time, where any LEDs in the channel remain on at the last calculated light intensity value of Curve 1, which may be any of the brightness levels, for the amount of time specified by the LED ON time. The LED ON time may be specified in the curve profile of Curve 1 in some embodiments. A next portion 808 of the stitched PWM curve begins immediately after the LED ON time, labeled as START Curve 2. The portion 808 implements a portion of Curve 2, from a START index number to a STOP index number, at a scaling factor of S2. A next portion 810 of the stitched PWM curve implements the LED OFF time, where any LEDs in the channel remains off for the amount of time specified by the LED OFF time. The LED OFF time may be specified in the curve profile of Curve 2 in some embodiments. Immediately after the LED OFF time, the entire stitched PWM curve may repeat.

It is noted that Curve 1 is used to implement a fade-in effect and Curve 2 is used to implement a fade-out effect in FIG. 8. The scaling parameter S associated with a fade-in effect (like Curve 1) can be used to implement a ramp up speed, while another scaling parameter S associated with a fade-out effect (like Curve 2) can be used to implement a ramp down speed. In some embodiments, a single bit start code may be received on a single input (like ENABLE0), where the processor is configured to automatically stitch Curve 1 and Curve 2 together by implementing the curve profile of Curve 1 and then immediately implement the curve profile of Curve 2, depending on the implementation of the LED controller.

As noted above, each of the light output curve profiles (also referred to as PWM curve profiles) includes information that represents a respective PWM curve, such as the set of 4 polynomial coefficients. In order to select one of the curve profiles, each light output curve profile is associated with a unique start code, where the LED controller 200 receives a start code value on the enable inputs ENABLE0 and ENABLE1. The received start code value is one of a possible 2M start code values, where at least one of the start code values is associated with a stand-by mode during which time no light output curve is implemented, or where a light intensity value equivalent to 0% brightness is implemented (e.g., the LEDs are dark). The remaining start code values are each associated with one of the light output curve profiles. The number of different light output curve profiles that are stored in MTP memory 204 is dependent on the size of the curve profiles, as well as the available storage size of the MTP memory 204. In addition to the 4 coefficients, each curve profile may include information that is used to implement the desired light output curve, such as a value of the scaling parameter S (which may be 3 bits wide), START and STOP index numbers (which each may be 8 bits wide), a value of the delay factor (which may be 8 bits wide), a value of the fade directional indicator (which may be a single bit wide), a value of the channel directional indicator (which may be a single bit wide), a channel subset indicator (which may be 8 bits wide), and LED ON or LED OFF time (which may be 8 bits wide).

The processor 202 of each LED controller 200 implements processing logic configured to receive the start code, retrieve a light output curve profile associated with the start code from local memory, and initialize the polynomial calculator with a set of coefficients from the retrieved light output curve profile. The processing logic is also configured to remain in a stand-by mode, if indicated to do so by the received start code. The processing logic is also configured to initialize the calculator with a selected S parameter from the retrieved light output curve profile. The processing logic is also configured to output one or more voltage levels to the PWM generators based on each light intensity value output by the calculator, which are used to generate PWM signals that implement the PWM curve at the matrix LED display. The processing logic may also be configured to output the one or more voltage levels to the PWM generators in a successively delayed manner, according to a delay factor from the retrieved light output curve profile. It is noted that the processing logic is triggered to perform these functions as part of a PWM curve process in response to receipt of the start code. The polynomial calculator used to calculate the light intensity values is further discussed below in connection with FIG. 6A.

Figure 7:
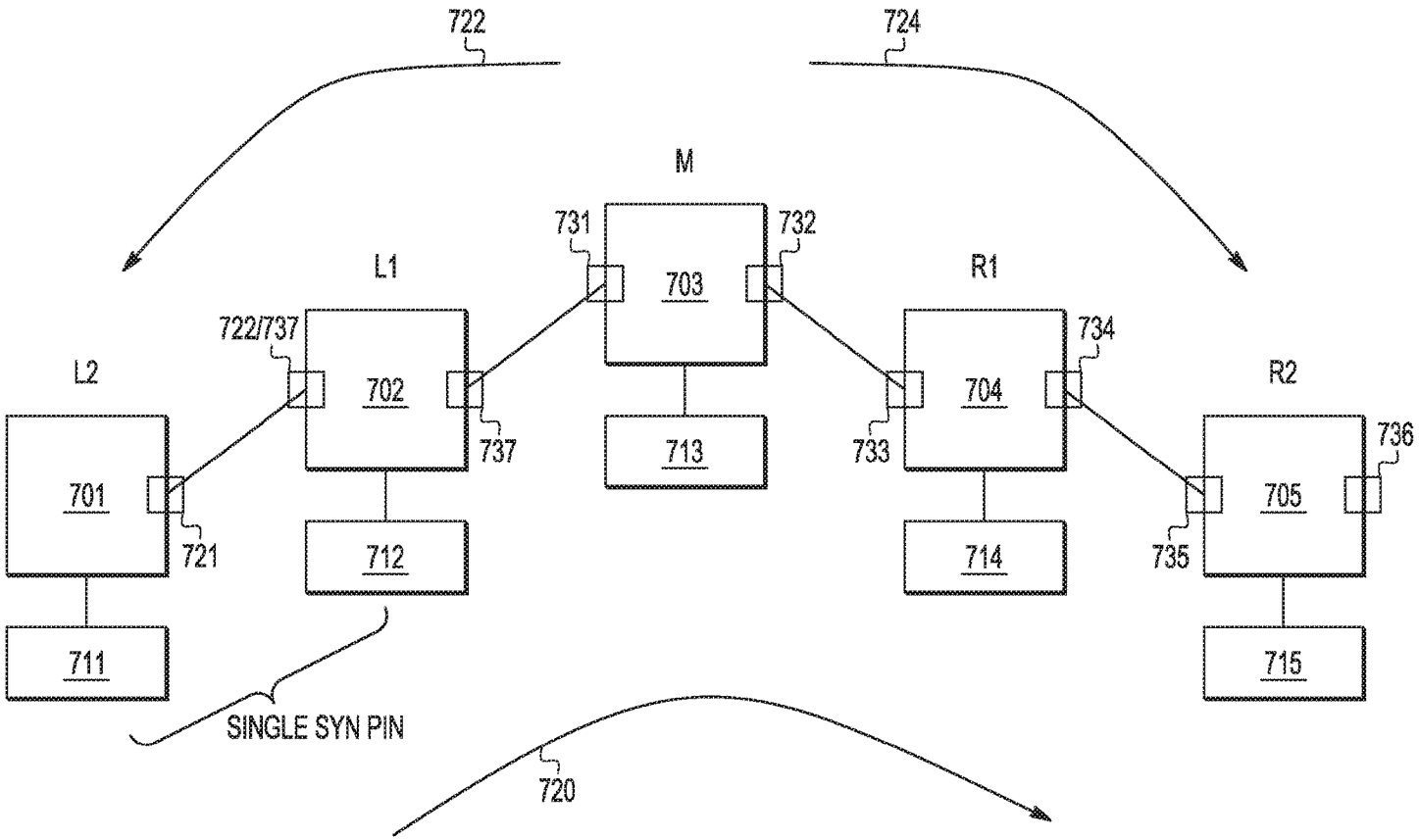
FIG. 7 illustrates a block diagram depicting an example matrix LED system that includes multiple standalone LED controllers, according to some embodiments.

Finally, as shown in FIG. 7, each LED controller may implement one or more SYNC lines or pins, where two LED controllers may be connected to one another using a SYNC line, in order to implement light output effects at multiple LED channels. In one embodiment, a first LED controller 701 has a SYNC pin 721 connected to a SYNC pin 722 of a second LED controller 702 via a single SYNC line (shown as the connecting line between 701 and 702), where both LED controllers locally store the same set of curve profiles that are identified by the same set of start codes. This embodiment is labeled as the single SYNC pin embodiment, which includes LED controllers 701 and 702, SYNC pins 721 and 722, and the connection between the pins 721 and 722.

In the single SYNC pin embodiment, the two LED controllers have a master/slave relationship, where one LED controller is configured to wait for a trigger signal or other start instruction from the other LED controller. For example, the first LED controller 701 may receive a start code that indicates a particular PWM curve is implemented, and, as the master controller, begins the PWM curve process described above to implement the desired light output effect at the matrix LED display 711. The second LED controller 702 may also receive the same start code, but is the slave controller and is configured to wait until a trigger signal is received on the SYNC line before beginning the PWM curve process described above. Once the first LED controller 701 completes the PWM curve process, the first LED controller 701 outputs an asserted signal on the SYNC line to trigger the second LED controller 702 to begin implementing the desired light output effect at the matrix LED display 712. Such a set-up may be especially useful when implementing a wiping light output effect across a number of LED channels in the pair of matrix LED displays 711-712 that are controlled by LED controllers 701-702. Continuing the example from FIG. 3, once the first LED controller 701 outputs the first voltage level of the sequence of voltage levels to the twelfth LED channel, the first LED controller 701 outputs the asserted signal on the SYNC line to trigger the second LED controller to begin outputting the sequence of voltage levels to each LED channel in a same successively delayed manner. The first LED controller 701 may also delay outputting the asserted signal on the SYNC line after the delay time has elapsed, such as in embodiments where the second LED controller 702 is ready and waiting to immediately begin outputting the sequence of voltage levels in response to the LED channels.

In other embodiments, two SYNC pins are implemented on each LED controller to allow multiple LED controllers to be connected in series, where the series-connected LED controllers 701-705 are also referred to as a string of LED controllers. As shown in FIG. 7, the second LED controller 702 has a first SYNC pin 738 connected to the first LED controller 701, and a second SYNC pin 737 connected to a SYNC pin 731 of the next LED controller 703. The remaining controllers 703-705 are similarly connected via SYNC pins 732-736.

This implementation of 2 SYNC pins allows light output effects to be implemented across multiple LED channels of matrix LED displays 711-715 controlled by LED controllers 701-705. For example, the wiping effect discussed above may be implemented across the matrix LED displays 711-715, illustrated as directional arrow 720 (which may in the opposite direction in other implementations). Similar to the single SYNC pin embodiment discussed above, the first LED controller 701 may receive a start code that indicates a particular PWM curve is implemented, and begins the PWM curve process described above to implement the desired light output effect at the matrix LED display 711. The LED controllers 702-705 may each also receive the same start code, but are configured to wait until a trigger signal is received on the respective SYNC line before beginning the PWM curve process described above. Once the first LED controller 701 completes the PWM curve process, the first LED controller 701 outputs an asserted signal on SYNC pin 721 to trigger the second LED controller 702 to begin implementing the desired light output effect at the matrix LED display 712. Similarly, once the second LED controller 702 completes the PWM curve process, the second LED controller 702 outputs an asserted signal on its SYNC pin 737 to trigger the next LED controller, and so on.

In another example, the wiping effect discussed above may be implemented in a split manner, from a middle of the string of LED controllers out toward the ends of the string LED controllers, illustrated as directional arrows 722 and 724. A middle (or intermediate) LED controller (labeled M) of a string of LED controllers is considered the first LED controller in this embodiment. The middle LED controller is coupled to a first left (L1) LED controller by a first SYNC line, and coupled to a first right (R1) LED controller by a second SYNC line. The middle LED controller may be configured to implement the PWM curve process (as discussed above) and then output an asserted signal on both first and second SYNC lines to trigger the first left and first right LED controllers together (e.g., both LED controllers simultaneously are triggered to begin the PWM curve process). The first left LED controller may be connected to a next left (L2) LED controller by another SYNC line, where the first left LED controller triggers the next left controller after completion of the PWM curve process at the first left LED controller. Similarly, the first right LED controller may be connected to a next right (R2) LED controller by yet another SYNC line, where the first right LED controller triggers the next right controller after completion of the PWM curve process at the first right LED controller. Multiple left and right LED controllers may be serially connected in a string by SYNC lines, where the wiping effect propagates away from the middle LED controller and out toward an end of the string of left LED controllers and out toward an end of the string of right LED controllers in a parallel manner.

It is also noted that this set-up may also achieve control of the multiple LED channels in a collective manner. For example, each of the multiple LED controllers may receive a same start code. If the delay value is 0 in the selected curve profile, the first LED controller immediately outputs an asserted signal on the SYNC line to the second LED controller, which immediately outputs an asserted signal on the SYNC line to trigger the next LED controller and so on. The perceived effect is that the same curve profile is implemented at each LED channel at the same time (assuming any delay arising from transmitting the asserted signal on subsequent SYNC lines is minimal).

Figure 6A:
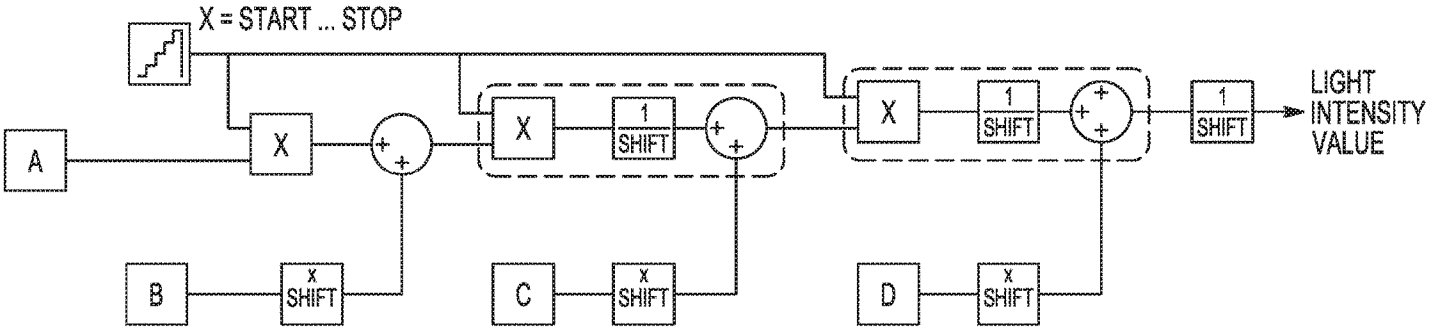
FIGS. 6A and 6B illustrate relevant components of an example calculator configured to calculate light intensity values, according to some embodiments.

FIG. 6A is a block diagram illustrating relevant components of an example polynomial calculator configured to calculate light intensity values. In the embodiments discussed herein, the polynomial calculator is configured to implement absolute value calculations. Absolute value calculations involve calculating each light intensity value according to the polynomial function provided above as Equation 2, where each light intensity value is calculated independently of other light intensity values on the PWM curve (as opposed to incremental value calculations that calculate each light intensity value dependent upon a previously calculated light intensity value). As described herein, an absolute value calculator is a digital implementation (e.g., digital circuitry using MOSFET technology). Equation 2 is reproduced here:

$$PWM(x) = A\frac{x^3}{S^3} + B\frac{x^2}{S^2} + C\frac{x}{S} + D \qquad \text{Eq. 2}$$

It is noted that a direct implementation of Equation 1 would multiply A by $x^3$, where A is 12 bits wide and x (as the index number) is 8 bits wide, requiring 12 bits+3(8 bits)=36 bits. Dividing $x^3$ by $S^3$ (where the S value is also 8 bits wide) in Equation 2 reduces the required bits down to 12 bits.

In order to reduce the number of multiplications used in the absolute value calculator, Horner's method is used to rewrite Equation 2 in a recursive manner, which allows a more efficient implementation in hardware (e.g., hardware is reused) and reduce the physical size of the logic:

$$PWM(x) = \left(\left(A\frac{x}{S} + B\right)\frac{x}{S} + C\right)\frac{x}{S} + D \qquad \text{Eq. 3}$$

Equation 3 can be rewritten as Equations 4 in a further factored form:

$$PWM(x) = \left\{\left(\left((Ax + BS)\frac{x}{S} + CS\right)\frac{x}{S} + DS\right\}\frac{1}{S} \qquad \text{Eq. 4}$$

As shown in FIG. 6A, the polynomial calculator is implemented as an absolute value calculator based on a polynomial function (shown in Equation 4) for calculating light intensity values of a PWM curve. A number of symbols are used in the diagrams of FIG. 6A. For example, a box labeled with a stair-stepping curve implements a free-running counter that provides a sequential set of index numbers by incrementing or decrementing a present index number to produce a subsequent index number. For example, for an 8 bit wide index number, the counter sequentially outputs the integers in an increasing order for fade-in calculations, and outputs the integers in a decreasing order for fade-out calculations, as indicated by the fade directional indicator. The free-running counter is configured to increment or decrement the index numbers at the PWM frequency (e.g., may be configured to receive the OSC signal that is also provided to the PWM generators of FIG. 2). The initial number used by the calculator of FIG. 6A is herein referred to as a START index number and the final number used by the calculator of FIG. 6 A is herein referred to as a STOP index number. The calculator uses the stored START index number (e.g., 0) and a STOP index number that is larger than the START index number (e.g., 255) for fade-in calculations, and uses the stored START index number (e.g., 255) and STOP index number that is smaller than the START index number (e.g., 0) for fade-out calculations.

Circles having a number of internal plus signs represent adders. Blocks labeled with "X" represent a multiplication operation. Blocks labeled "A", "B", "C", and "D" represent the polynomial coefficients (12 bits) and may also be implemented as registers that are initialized with the retrieved set of coefficients of the selected curve profile by processing logic of the LED controller. Blocks labeled with "1/SHIFT" represent a division operation by the SHIFT parameter (which is referred to as the S parameter above), which is implemented by a bit shifter that shifts bits to the right. For example, dividing a coefficient by a SHIFT value of 256 would require shifting the bits of the coefficient to the right by 8 bits, while a SHIFT value of 128 would require shifting the bits to the right by 7 bits. Blocks labeled with "X SHIFT" represent a multiplication operation by the SHIFT parameter, which is implemented by a bit shifter that shifts bits to the left. For example, multiplying a coefficient by a SHIFT value of 256 would require shifting the bits of the coefficient to the left by 8 bits, while a SHIFT value of 128 would require shifting the bits to the left by 7 bits.

In FIG. 6A, coefficient A is multiplied by the START index number, and coefficient B is multiplied (or shifted left) by the SHIFT parameter, which are added to produce a first summation (which is the first parenthetical term (Ax+BS) shown above in Equation 4). The first summation is multiplied by the START index number and divided (or shifted right) by the SHIFT parameter, and coefficient C is by the SHIFT parameter, which are added to produce a second summation (which is the second parenthetical term ((Ax+BS)×/S+CS) shown above in Equation 4). The second summation is multiplied by the START index number and divided by the SHIFT parameter, coefficient D is multiplied by the SHIFT parameter, which are added to produce a third summation (which is the overall bracketed term of Equation 4). The third summation is divided by the SHIFT parameter and provided as the presently calculated light intensity value.

Figure 6B:
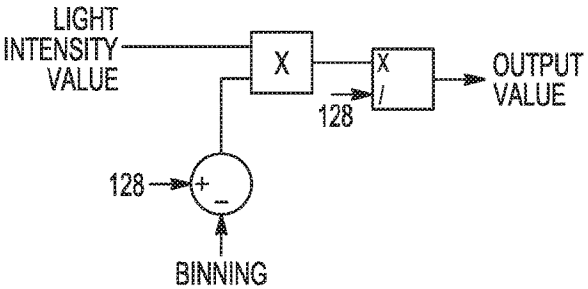

FIG. 6B is a block diagram illustrating an example binning circuit. Optionally, in some embodiments, the absolute value calculator of FIG. 6A may also include a binning circuit, which is used to further adjust the light intensity value in order to adjust the duty cycle of the PWM signal for each channel. In other words, the binning circuit provides a way to adjust the light output of each channel in order to match the light output of the LEDs when the LEDs have uneven or unmatched light outputs at a same PWM signal (e.g., some LEDs are newer and can achieve a higher brightness level than other LEDs, or some LEDs are older and are not efficiently activated by the same current in comparison to the other LEDs). In this embodiment, the binning factor (labeled "BINNING") is 5 bits wide and is used to scale down the calculated light intensity value, where a binning factor of 0 achieves an output value that is 100% of the calculated light intensity value, and a maximum binning factor of 31 achieves an output value that is 75% of the calculated light intensity value. For example, the binning circuit shown implements a scaled percentage by subtracting the binning factor from 128 and dividing by 128. The output value is used to output one or more voltages to the PWM generators to control the light output of the LEDs, as described above.

By now it should be appreciated that there has been provided a standalone light emitting diode (LED) controller that is able to individually control the light output of one or more LEDs in a matrix LED display. Such an LED controller is configured to implement a desired light output curve at the one or more LEDs using one or more pulse width modulation (PWM) signals based on light intensity values that are calculated locally at the standalone LED controller. Multiple standalone LED controllers may be coupled in series and may use one or more SYNC lines to coordinate light output effects implemented at the LEDs of multiple matrix LED displays, which eliminates the need for a central microcontroller to coordinate light output of the matrix LED displays.

In one embodiment of the present disclosure, a matrix light emitting diode (LED) system is provided, which includes: a first LED controller connectable to a first matrix of LEDs, the first LED controller including: at least one input pin configured to receive a first start code value; a programmable local memory configured to store a set of curve profiles, wherein each curve profile stores a different set of coefficient values, and curve profile is associated with a different start code value; a processor coupled to the at least one input pin and the programmable local memory, the processor configured to: in response to receipt of the first start code value: initialize a set of coefficients of a polynomial calculator with a set of values defined in a selected curve profile associated with the first start code that is retrieved from the programmable local memory, wherein the set of values represent a desired light output curve, and output a set of voltage levels based on a presently calculated light intensity value output by the polynomial calculator; and a set of pulse width modulation (PWM) generators configured to output a set of PWM signals based on the set of voltage levels corresponding to the presently calculated light intensity value, wherein each PWM signal controls light output of a respective LED of the first matrix of LEDs.

One aspect of the above embodiment provides that a second start code value indicates a stand-by mode, wherein the processor is configured to output a light intensity value of 0% brightness as the presently calculated light intensity value to each of the set of PWM generators during the stand-by mode.

Another aspect of the above embodiment provides that the at least one input pin includes a pair of binary input pins configured to receive one of four different start code values, and the set of curve profiles includes a maximum of three different curve profiles.

Another aspect of the above embodiment provides that the programmable local memory is coupled to a programming interface including two or more pins configured to write a number of curve profiles to the programmable local memory.

Another aspect of the above embodiment provides that each PWM generator includes: a comparator configured to receive a digital oscillating signal and a respective voltage level of the set of voltage levels, wherein the respective voltage level controls a duty cycle of the PWM signal.

Another aspect of the above embodiment provides that the LED controller further includes: a plurality of switches coupled to the matrix of LEDs, wherein each PWM signal is provided to a control gate electrode of a respective switch coupled in parallel with a respective LED in the matrix of LEDs, and each PWM signal controls a switching period of the respective switch to turn the respective LED on and off to implement a time-averaged brightness level of the light output of the respective LED according to the desired light output curve.

Another aspect of the above embodiment provides that the polynomial calculator, when initialized with the set of coefficients, is configured to implement a polynomial function that describes the desired light output curve, wherein the polynomial function defines light intensity values as a function of index number.

Another aspect of the above embodiment provides that each of the set of curve profiles further stores a scaling parameter value that indicates a number of time units over which the desired light output curve extends, and the processor is further configured to: initialize a scaling parameter of the polynomial calculator with the scaling parameter value stored in the selected curve profile.

Another aspect of the above embodiment provides that each of the set of curve profiles further stores a fade directional indicator value that indicates one of a fade-in light output effect or a fade-out light output effect, and the processor is further configured to: initialize a counter of the polynomial calculator to sequentially increment an index value from a minimum value to a maximum value to generate a set of index numbers in a first sequential order, in response to a first fade directional indicator value stored in the selected curve profile, and initialize the counter of the polynomial calculator to sequentially decrement an index value from the maximum value to the minimum value to generate a set of index numbers in a second sequential order opposite the first sequential order, in response to a second fade directional indicator value stored in the selected curve profile.

Another aspect of the above embodiment provides that the polynomial calculator is further configured to: calculate a sequence of light intensity values at an update rate equivalent to a frequency utilized by the PWM generators to generate the PWM signals, and the processor is further configured to: output sets of voltage levels to the set of PWM generators in a sequential manner based on the sequence of light intensity values.

Another aspect of the above embodiment provides that the first LED controller further includes: a fault detection circuit configured to detect one or more possible failures including: an open circuit failure in the first matrix of LEDs, a short circuit failure in the first matrix of LEDs, and a temperature excursion; and a fault output line, wherein the processor is configured to output a fault code on the fault output line in response to a detected failure.

Another aspect of the above embodiment provides that the processor is further configured to: for each light intensity value calculated: provide a voltage level corresponding to the light intensity value to the set of PWM generators in a successively delayed manner, wherein the selected curve profile further includes a delay factor that defines a delay time, the processor is configured to output the voltage level to a first PWM generator at a first time, the processor is configured to output the voltage level to a second PWM generator at a second time after the first time, where the second time is delayed after the first time by the delay time.

A further aspect of the above embodiment provides that the successively delayed manner achieves a wiping light output effect at the first matrix of LEDs, wherein the desired light output curve is implemented at a first LED channel positioned at one end of the first matrix of LEDs and is sequentially propagated through each LED of the first matrix of LEDs to a last LED channel positioned at another end of the first matrix of LEDs, according to a channel directional indicator.

Another aspect of the above embodiment provides that receipt of the first start code value triggers the first LED controller to output a first sequence of voltage levels to the set of PWM generators on the first LED controller, wherein the first sequence of voltage levels correspond to a first sequence of light intensity values calculated by the polynomial calculator on the first LED controller.

A further aspect of the above embodiment provides that the first LED controller further includes: a first synchronization pin connectable to a second LED controller that in turn is connectable to a second matrix of LEDs, wherein the first synchronization pin is configured to output a start signal to the second LED controller, and the start signal triggers the second LED controller to output a second sequence of voltage levels to a second set of PWM generators on the second LED controller, wherein the second sequence of voltage levels correspond to a second sequence of light intensity values calculated by a polynomial calculator on the second LED controller.

A further aspect of the above embodiment provides that the first LED controller further includes: a second synchronization pin connectable to a third LED controller that in turn is connectable to a third matrix of LEDs, wherein the second synchronization pin is configured to output a start signal to the third LED controller, the start signal triggers the third LED controller to output a third sequence of voltage levels to a third set of PWM generators on the third LED controller, wherein the third sequence of voltage levels correspond to a third sequence of light intensity values calculated by a polynomial calculator on the third LED controller.

A still further aspect of the above embodiment provides that the first, second, and third LED controllers receive the first start code value associated with the selected curve profile, the selected curve profile indicates a split wiping light output effect, after the first sequence of voltage levels is output to the set of PWM generators, the first LED controller is configured to output the start signal simultaneously to the second and third LED controllers on the first and second synchronization pins.

A still further aspect of the above embodiment provides that the selected curve profile indicates a delay time greater than zero, the first LED controller is configured to output the first sequence of voltage levels to each subsequent PWM generator on the first LED controller in a successively delayed manner, according to the delay time, the first LED controller is configured to output the start signal to the second and third LED controllers after a first voltage level of the first sequence of voltage levels is output to a last PWM generator, and the second and third LED controllers are respectively configured to output the second and third sequence of voltage levels to the second and third sets of PWM generators in the successively delayed manner, according to the delay time.

Another aspect of the above embodiment provides that the matrix LED system further includes: a plurality of LED controllers that includes the first LED controller, each communicatively coupled to one another in series, and each coupled to a respective matrix of LEDs.

A further aspect of the above embodiment provides that the selected curve profile indicates a delay time greater than zero, the first LED controller is configured to output a first sequence of voltage levels to each subsequent PWM generator on the first LED controller in a successively delayed manner, the first LED controller is configured to output a start signal to a next LED controller coupled to the first LED controller after a first voltage level of the first sequence of voltage levels is output to a last PWM generator, and the next LED controller is triggered by the start signal to output a second sequence of voltage levels each subsequent PWM generator on the next LED controller.

As used herein, a "node" means any internal or external reference point, connection point, junction, signal line, conductive element, or the like, at which a given signal, logic level, voltage, data pattern, current, or quantity is present. Furthermore, two or more nodes may be realized by one physical element (and two or more signals can be multiplexed, modulated, or otherwise distinguished even though received or output at a common mode).

The following description refers to nodes or features being "connected" or "coupled" together. As used herein, unless expressly stated otherwise, "coupled" means that one node or feature is directly or indirectly joined to (or is in direct or indirect communication with) another node or feature, and not necessarily physically. As used herein, unless expressly stated otherwise, "connected" means that one node or feature is directly joined to (or is in direct communication with) another node of feature. For example, a switch may be "coupled to a plurality of nodes, but all of those nodes need not always be "connected" to each other; the switch may connect different nodes to each other depending upon the state of the switch. Furthermore, although the various schematics shown herein depict certain example arrangements of elements, additional intervening elements, devices, features, or components may be present in an actual embodiment (assuming that the functionality of the given circuit is not adversely affected).

As used herein, the term "bus" is used to refer to a plurality of signals or conductors which may be used to transfer one or more various types of information, such as data, addresses, control, or status. The conductors as discussed herein may be illustrated or described in reference to being a single conductor, a plurality of conductors, unidirectional conductors, or bidirectional conductors. However, different embodiments may vary the implementation of the conductors. For example, separate unidirectional conductors may be used rather than bidirectional conductors and vice versa. Also, plurality of conductors may be replaced with a single conductor that transfers multiple signals serially or in a time multiplexed manner. Likewise, single conductors carrying multiple signals may be separated out into various different conductors carrying subsets of these signals. Therefore, many options exist for transferring signals.

The terms "activate" (or "assert" or "set") and "negate" (or "deassert" or "clear") are used herein when referring to the rendering of a signal, status bit, or similar apparatus into its logically true or logically false state, respectively. If the logically true state is a logic level one, the logically false state is a logic level zero. And if the logically true state is a logic level zero, the logically false state is a logic level one.

Each signal described herein may be designed as positive or negative logic, where negative logic can be indicated by a bar over the signal name or an asterisk (*) following the name. In the case of a negative logic signal, the signal is active low where the logically true state corresponds to a logic level zero. In the case of a positive logic signal, the signal is active high where the logically true state corresponds to a logic level one. Note that any of the signals described herein can be designed as either negative or positive logic signals. Therefore, in alternate embodiments, those signals described as positive logic signals may be implemented as negative logic signals, and those signals described as negative logic signals may be implemented as positive logic signals.

Because the apparatus implementing the present invention is, for the most part, composed of electronic components and circuits known to those skilled in the art, circuit details will not be explained in any greater extent than that considered necessary as illustrated above, for the understanding and appreciation of the underlying concepts of the present invention and in order not to obfuscate or distract from the teachings of the present invention.

Although the invention has been described with respect to specific conductivity types or polarity of potentials, skilled artisans appreciated that conductivity types and polarities of potentials may be reversed.

Moreover, the terms "front," "back," "top," "bottom," "over," "under" and the like in the description and in the claims, if any, are used for descriptive purposes and not necessarily for describing permanent relative positions. It is understood that the terms so used are interchangeable under appropriate circumstances such that the embodiments of the invention described herein are, for example, capable of operation in other orientations than those illustrated or otherwise described herein.

The processor described herein may be configured to run one or more programs. The term "program," as used herein, is defined as a sequence of instructions designed for execution on a computer system. A program, or computer program, may include a subroutine, a function, a procedure, an object method, an object implementation, an executable application, an applet, a servlet, a source code, an object code, a shared library/dynamic load library and/or other sequence of instructions designed for execution on a computer system.

Also for example, in one embodiment, the illustrated components of LED controller 200 are circuitry located on a single integrated circuit or PCB or within a same device. Alternatively, the components of LED controller 200 may include any number of separate integrated circuits or separate devices interconnected with each other. For example, memory 204 may be located on a same integrated circuit as processor 202 or on a separate integrated circuit or located within another peripheral or slave discretely separate from processor 202. Peripheral and I/O circuitry may also be located on separate integrated circuits or devices. Also for example, LED controller 200 may be embodied in a hardware description language of any appropriate type, where portions of LED controller 200 may be soft or code representations of physical circuitry or of logical representations convertible into physical circuitry.

Memory 204 is a computer readable storage medium, which may be permanently or removably coupled to processor 202. The computer readable media may include, for example and without limitation, any number of the following: magnetic storage media including disk and tape storage media; optical storage media such as compact disk media (e.g., CD-ROM, CD-R, etc.) and digital video disk storage media; nonvolatile memory storage media including semiconductor-based memory units such as FLASH memory, EEPROM, EPROM, ROM; ferromagnetic digital memories; MRAM; volatile storage media including registers, buffers or caches, main memory, RAM, etc.; and data transmission media including computer networks, point-to-point telecommunication equipment, and carrier wave transmission media, just to name a few.

Although the invention is described herein with reference to specific embodiments, various modifications and changes can be made without departing from the scope of the present invention as set forth in the claims below. For example, additional or fewer LEDs may be implemented in FIG. 2. Accordingly, the specification and figures are to be regarded in an illustrative rather than a restrictive sense, and all such modifications are intended to be included within the scope of the present invention. Any benefits, advantages, or solutions to problems that are described herein with regard to specific embodiments are not intended to be construed as a critical, required, or essential feature or element of any or all the claims.

Furthermore, the terms "a" or "an," as used herein, are defined as one or more than one. Also, the use of introductory phrases such as "at least one" and "one or more" in the claims should not be construed to imply that the introduction of another claim element by the indefinite articles "a" or "an" limits any particular claim containing such introduced claim element to inventions containing only one such element, even when the same claim includes the introductory phrases "one or more" or "at least one" and indefinite articles such as "a" or "an." The same holds true for the use of definite articles.

Unless stated otherwise, terms such as "first" and "second" are used to arbitrarily distinguish between the elements such terms describe. Thus, these terms are not necessarily intended to indicate temporal or other prioritization of such elements.

What is claimed is:

1. A matrix light emitting diode (LED) system comprising:

a first LED controller connectable to a first matrix of LEDs, the first LED controller comprising:

at least one input pin configured to receive a first start code value;

a programmable local memory configured to store a set of curve profiles, wherein each curve profile stores a different set of coefficient values, and curve profile is associated with a different start code value;

a processor coupled to the at least one input pin and the programmable local memory, the processor configured to:

in response to receipt of the first start code value:

initialize a set of coefficients of a polynomial calculator with a set of values defined in a selected curve profile associated with the first start code that is retrieved from the programmable local memory, wherein the set of values represent a desired light output curve, and output a set of voltage levels based on a presently calculated light intensity value output by the polynomial calculator; and a set of pulse width modulation (PWM) generators configured to output a set of PWM signals based on the set of voltage levels corresponding to the presently calculated light intensity value, wherein each PWM signal controls light output of a respective LED of the first matrix of LEDs.

2. The matrix LED system of claim 1, wherein a second start code value indicates a stand-by mode, wherein the processor is configured to output a light intensity value of 0% brightness as the presently calculated light intensity value to each of the set of PWM generators during the stand-by mode.

3. The matrix LED system of claim 1, wherein the at least one input pin comprises a pair of binary input pins configured to receive one of four different start code values, and the set of curve profiles comprises a maximum of three different curve profiles.

4. The matrix LED system of claim 1, wherein the programmable local memory is coupled to a programming interface comprising two or more pins configured to write a number of curve profiles to the programmable local memory.

5. The matrix LED system of claim 1, wherein each PWM generator comprises:

a comparator configured to receive a digital oscillating signal and a respective voltage level of the set of voltage levels, wherein the respective voltage level controls a duty cycle of the PWM signal.

6. The matrix LED system of claim 1, wherein the LED controller further comprises:

a plurality of switches coupled to the matrix of LEDs, wherein each PWM signal is provided to a control gate electrode of a respective switch coupled in parallel with a respective LED in the matrix of LEDs, and each PWM signal controls a switching period of the respective switch to turn the respective LED on and off to implement a time-averaged brightness level of the light output of the respective LED according to the desired light output curve.

7. The matrix LED system of claim 1, wherein the polynomial calculator, when initialized with the set of coefficients, is configured to implement a polynomial function that describes the desired light output curve, wherein the polynomial function defines light intensity values as a function of index number.

8. The matrix LED system of claim 1, wherein each of the set of curve profiles further stores a scaling parameter value that indicates a number of time units over which the desired light output curve extends, and the processor is further configured to:

initialize a scaling parameter of the polynomial calculator with the scaling parameter value stored in the selected curve profile.

9. The matrix LED system of claim 1, wherein each of the set of curve profiles further stores a fade directional indicator value that indicates one of a fade-in light output effect or a fade-out light output effect, and the processor is further configured to:

initialize a counter of the polynomial calculator to sequentially increment an index value from a minimum value to a maximum value to generate a set of index numbers in a first sequential order, in response to a first fade directional indicator value stored in the selected curve profile, and initialize the counter of the polynomial calculator to sequentially decrement an index value from the maximum value to the minimum value to generate a set of index numbers in a second sequential order opposite the first sequential order, in response to a second fade directional indicator value stored in the selected curve profile.

10. The matrix LED system of claim 1, wherein the polynomial calculator is further configured to:

calculate a sequence of light intensity values at an update rate equivalent to a frequency utilized by the PWM generators to generate the PWM signals, and the processor is further configured to:

output sets of voltage levels to the set of PWM generators in a sequential manner based on the sequence of light intensity values.

11. The matrix LED system of claim 1, wherein the first LED controller further comprises:

a fault detection circuit configured to detect one or more possible failures including: an open circuit failure in the first matrix of LEDs, a short circuit failure in the first matrix of LEDs, and a temperature excursion; and a fault output line, wherein the processor is configured to output a fault code on the fault output line in response to a detected failure.

12. The matrix LED system of claim 1, wherein the processor is further configured to:

for each light intensity value calculated:

provide a voltage level corresponding to the light intensity value to the set of PWM generators in a successively delayed manner, wherein the selected curve profile further includes a delay factor that defines a delay time, the processor is configured to output the voltage level to a first PWM generator at a first time, the processor is configured to output the voltage level to a second PWM generator at a second time after the first time, where the second time is delayed after the first time by the delay time.

13. The matrix LED system of claim 12, wherein the successively delayed manner achieves a wiping light output effect at the first matrix of LEDs, wherein the desired light output curve is implemented at a first LED channel positioned at one end of the first matrix of LEDs and is sequentially propagated through each LED of the first matrix of LEDs to a last LED channel positioned at another end of the first matrix of LEDs, according to a channel directional indicator.

14. The matrix LED system of claim 1, wherein receipt of the first start code value triggers the first LED controller to output a first sequence of voltage levels to the set of PWM generators on the first LED controller, wherein the first sequence of voltage levels correspond to a first sequence of light intensity values calculated by the polynomial calculator on the first LED controller.

15. The matrix LED system of claim 14, wherein the first LED controller further comprises:

a first synchronization pin connectable to a second LED controller that in turn is connectable to a second matrix of LEDs, wherein the first synchronization pin is configured to output a start signal to the second LED controller, and the start signal triggers the second LED controller to output a second sequence of voltage levels to a second set of PWM generators on the second LED controller, wherein the second sequence of voltage levels correspond to a second sequence of light intensity values calculated by a polynomial calculator on the second LED controller.

16. The matrix LED system of claim 15, wherein the first LED controller further comprises:

a second synchronization pin connectable to a third LED controller that in turn is connectable to a third matrix of LEDs, wherein the second synchronization pin is configured to output a start signal to the third LED controller, the start signal triggers the third LED controller to output a third sequence of voltage levels to a third set of PWM generators on the third LED controller, wherein the third sequence of voltage levels correspond to a third sequence of light intensity values calculated by a polynomial calculator on the third LED controller.

17. The matrix LED system of claim 16, wherein the first, second, and third LED controllers receive the first start code value associated with the selected curve profile, the selected curve profile indicates a split wiping light output effect, after the first sequence of voltage levels is output to the set of PWM generators, the first LED controller is configured to output the start signal simultaneously to the second and third LED controllers on the first and second synchronization pins.

18. The matrix LED system of claim 17, wherein the selected curve profile indicates a delay time greater than zero, the first LED controller is configured to output the first sequence of voltage levels to each subsequent PWM generator on the first LED controller in a successively delayed manner, according to the delay time, the first LED controller is configured to output the start signal to the second and third LED controllers after a first voltage level of the first sequence of voltage levels is output to a last PWM generator, and the second and third LED controllers are respectively configured to output the second and third sequence of voltage levels to the second and third sets of PWM generators in the successively delayed manner, according to the delay time.

19. The matrix LED system of claim 1, further comprising:

a plurality of LED controllers that comprises the first LED controller, each communicatively coupled to one another in series, and each coupled to a respective matrix of LEDs.

20. The matrix LED system of claim 19, wherein the selected curve profile indicates a delay time greater than zero, the first LED controller is configured to output a first sequence of voltage levels to each subsequent PWM generator on the first LED controller in a successively delayed manner, the first LED controller is configured to output a start signal to a next LED controller coupled to the first LED controller after a first voltage level of the first sequence of voltage levels is output to a last PWM generator, and the next LED controller is triggered by the start signal to output a second sequence of voltage levels each subsequent PWM generator on the next LED controller.

* * * * *